US011156427B2

(12) United States Patent
McPherson

(10) Patent No.: US 11,156,427 B2
(45) Date of Patent: Oct. 26, 2021

(54) ARCHERY BOW WITH STACKED LIMBS

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/842,477

(22) Filed: Apr. 7, 2020

(65) Prior Publication Data

US 2020/0232745 A1 Jul. 23, 2020

Related U.S. Application Data

(63) Continuation of application No. 16/178,405, filed on Nov. 1, 2018, now Pat. No. 10,612,882.

(60) Provisional application No. 62/580,361, filed on Nov. 1, 2017.

(51) Int. Cl.
*F41B 5/10* (2006.01)

(52) U.S. Cl.
CPC ..... *F41B 5/10* (2013.01); *F41B 5/105* (2013.01)

(58) Field of Classification Search
CPC ..... F41B 5/00; F41B 5/10
See application file for complete search history.

(56) References Cited

U.S. PATENT DOCUMENTS

| | | | | |
|---|---|---|---|---|
| 2,736,309 | A | 2/1956 | Hoffman | |
| 4,246,883 | A | 1/1981 | Ash | |
| 4,644,929 | A | 2/1987 | Peck | |
| 5,429,106 | A | 7/1995 | Martin | |
| 5,720,267 | A | 2/1998 | Walk | |
| 5,722,380 | A | 3/1998 | Land | |
| 6,024,076 | A | 2/2000 | Laborde | |
| 6,371,098 | B1 * | 4/2002 | Winther | F41B 5/0005 124/23.1 |
| 6,684,870 | B1 | 2/2004 | Land | |
| 6,964,271 | B2 | 11/2005 | Andrews | |
| 7,584,750 | B2 | 9/2009 | Chang | |
| 7,784,452 | B1 | 8/2010 | Kronengold | |
| 7,918,218 | B1 | 4/2011 | Kronengold et al. | |
| 8,069,847 | B2 | 12/2011 | Blosser | |
| 8,347,869 | B2 | 1/2013 | Sims | |
| 8,651,094 | B2 | 2/2014 | Matasic | |
| 8,776,770 | B2 | 7/2014 | Bardorf | |
| 10,359,253 | B2 | 7/2019 | Peacemaker et al. | |
| 10,502,517 | B1 * | 12/2019 | Ellis, Jr. | F41B 5/10 |
| 10,612,882 | B2 * | 4/2020 | McPherson | F41B 5/10 |
| 10,627,185 | B2 | 4/2020 | Marriot et al. | |
| 2004/0077440 | A1 | 4/2004 | Kronfeld | |
| 2008/0072888 | A1 | 3/2008 | Chang | |
| 2008/0156310 | A1 | 7/2008 | Leven | |
| 2009/0071458 | A1 | 3/2009 | Gordon et al. | |
| 2009/0241928 | A1 | 10/2009 | Blosser | |
| 2013/0061839 | A1 | 3/2013 | Asherman | |

* cited by examiner

*Primary Examiner* — John A Ricci
(74) *Attorney, Agent, or Firm* — Laabs Intellectual Property

(57) ABSTRACT

In some embodiments, a limb assembly comprises a limb cup, a first limb member and a second limb member. The first limb member supports a rotatable member. The first limb member is supported by the limb cup at a first location and is supported by the second limb member at a second location. The second limb member is supported by the limb cup. The second limb member applies a supporting force to the first limb member.

19 Claims, 9 Drawing Sheets

ARCHERY BOW WITH STACKED LIMBS

CROSS-REFERENCE TO RELATED APPLICATIONS

This application claims the benefit and is a continuation of U.S. patent application Ser. No. 16/178,405, filed Nov. 1, 2018, which claims the benefit of U.S. Patent Application No. 62/580,361, filed Nov. 1, 2017, the entire content of which are hereby incorporated herein by reference.

BACKGROUND OF THE INVENTION

This invention relates generally to archery bows and more specifically to limb configurations for archery bows.

Archery bow limbs are often highly stressed, even in an undrawn condition of the bow. As the bow is drawn, the limbs will flex and store additional energy. Thus, a limb must be strong and robust. There is also a competing desire for limbs to be as light as possible.

There remains a need for novel limb configurations that provide improvements in efficiency and longevity when compared to prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a limb assembly comprises a limb cup, a first limb member and a second limb member. The first limb member supports a rotatable member. The first limb member is supported by the limb cup at a first location and is supported by the second limb member at a second location. The second limb member is supported by the limb cup. The second limb member applies a supporting force to the first limb member.

In some embodiments, an archery bow comprises a riser, a first limb member supported by the riser and a second limb member supported by the riser. A bracket is supported by the first limb member and the second limb member. A rotatable member is supported by the bracket.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
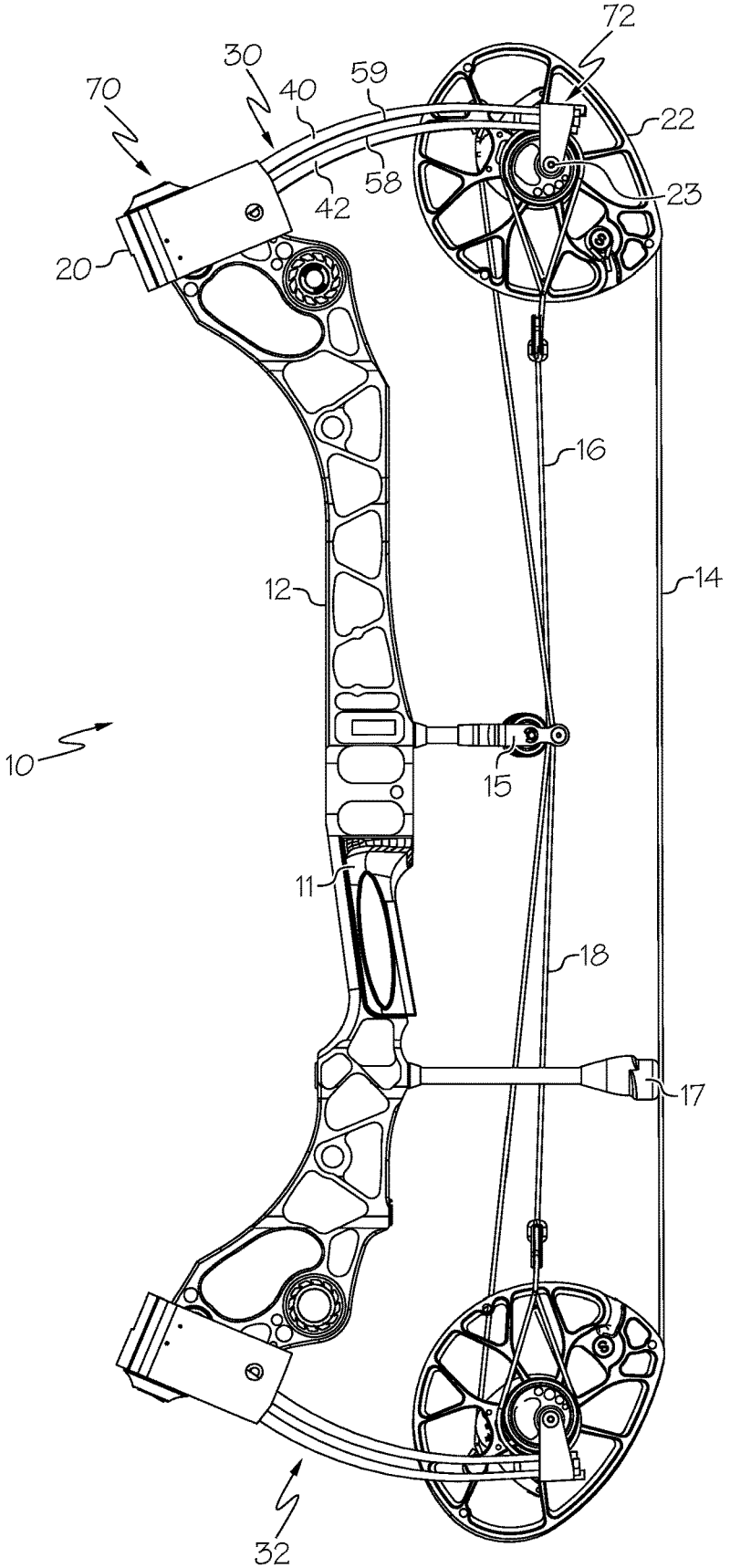
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10. In some embodiments, an archery bow 10 comprises a riser 12 arranged to support a first limb assembly 30 and a second limb assembly 32. In some embodiments, the bow 10 comprises a limb cup 20 is supported by the riser 12, and the limb cup 20 receives and supports limb members as described herein. In some embodiments, the first limb assembly 30 supports a first rotatable member 22 and the second limb assembly 32 supports a second rotatable member 24.

In some embodiments, an archery bow 10 comprises a compound bow, for example comprising a bowstring 14 and a power cable 14. In various embodiments, an archery bow 10 can comprise any type of compound bow. For example, in some embodiments, a bow 10 comprises a single cam bow, for example where one rotatable member comprises a cam and the other rotatable member comprises a pulley. A single cam bow (not shown) can comprise a high force power cable 16 and a low force second cable that wraps around the pulley comprises a bowstring portion and a control cable portion. In some embodiments, a bow 10 comprises a cam-and-a-half bow, for example where one rotatable member comprises a high force cam and the other rotatable member comprises a low force/half-cam. A cam-and-a-half bow can comprise a high force power cable 16, a low force bowstring 14 that feeds out from both rotatable members as the bow is drawn, and a low force control cable that feeds out from one rotatable member at one end and is taken up on the half-cam at the other end. As shown in FIG. 1, the bow 10 comprises a two-cam bow comprising a bowstring 14, a first high force power cable 16 and a second high force power cable 18.

In some embodiments, a bow 10 comprises a cable guard 15, for example as taught in U.S. Pat. No. 8,402,960. In some embodiments, a bow 10 comprises a string stop 17, for example as taught in U.S. Pat. No. 8,408,195. In some embodiments, a bow 10 comprises a grip 11, for example as taught in U.S. Pat. No. 8,622,052. These patents are hereby incorporated herein by reference in their entireties.

Figure 2:
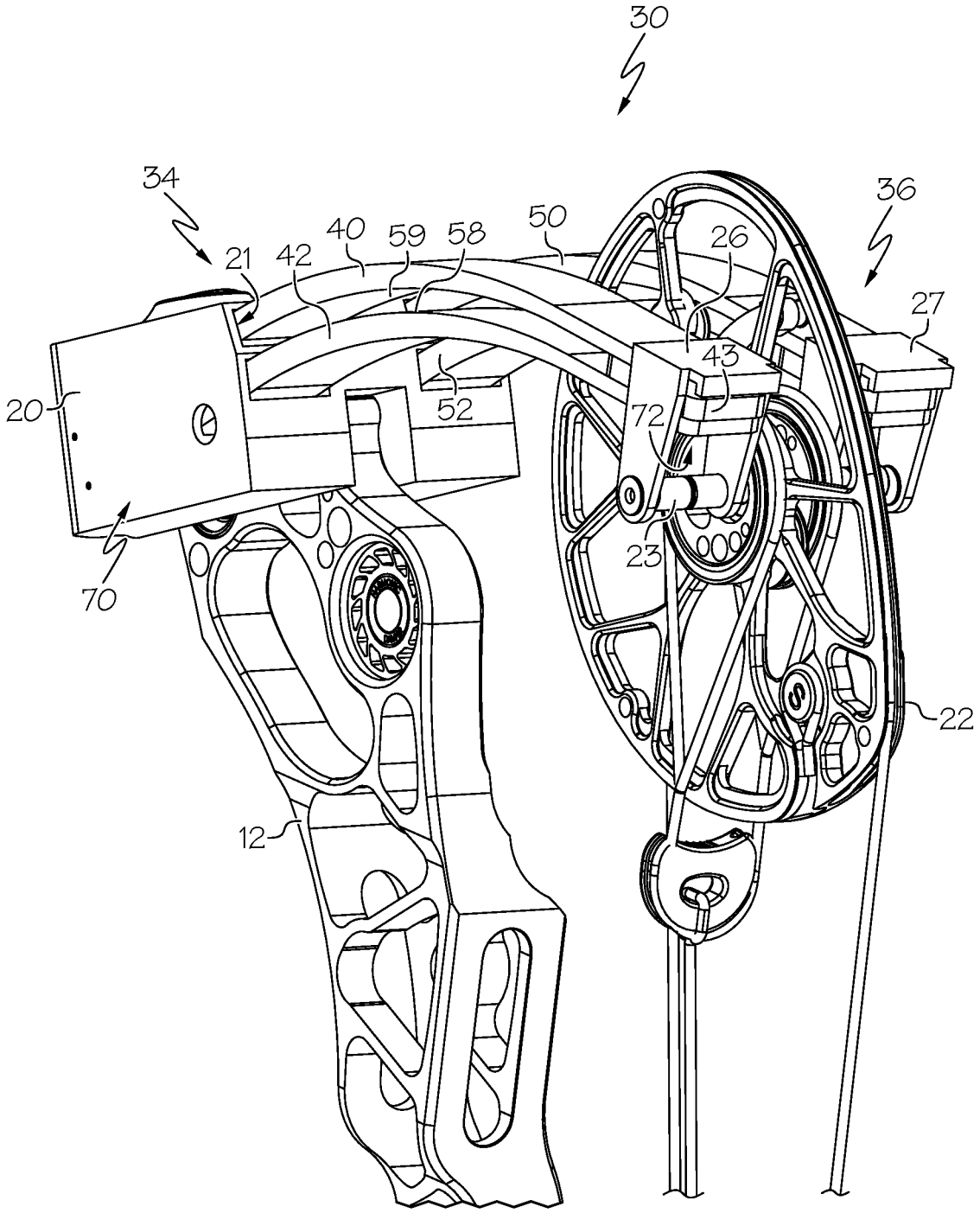
FIG. 2 shows an embodiment of a limb assembly in greater detail.
Figure 3:
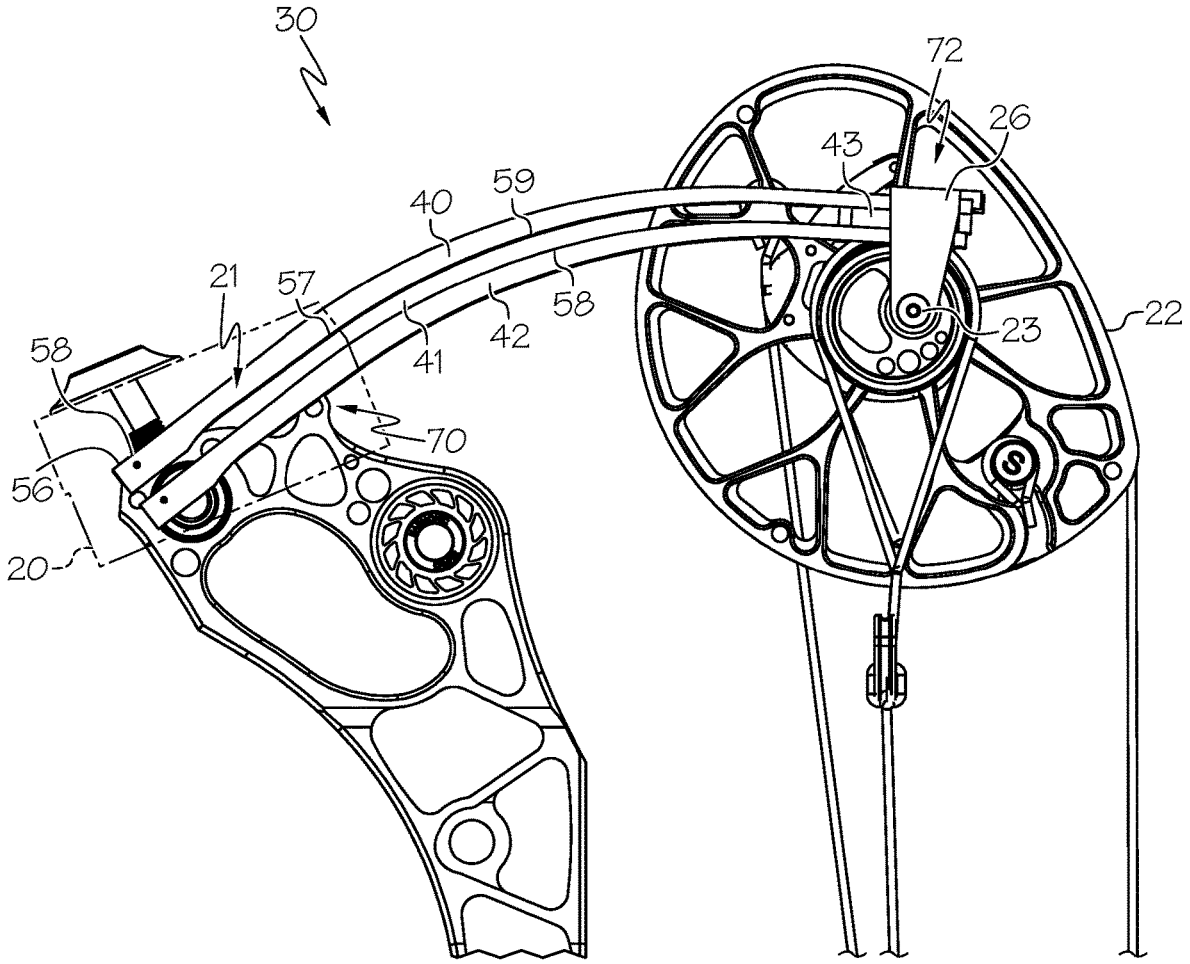
FIG. 3 shows a side view of an embodiment of a limb assembly.

Referring to FIGS. 1-3, in some embodiments, a limb assembly 30 comprises a first limb member 40 and a second limb member 42, wherein the first limb member 40 is generally stacked above the second limb member 42. In some embodiments, the first limb member 40 supports the rotatable member 22. In some embodiments, the second limb member 42 supports the first limb member 40. In some embodiments, a compression surface 59 of the first limb member 40 is adjacent to a tension surface 58 of the second limb member 42.

A limb assembly 30 can engage and support a rotatable member 22 in any suitable way. In some embodiments, a limb assembly 30 supports a hanger bracket 26, and the hanger bracket 26 supports the rotatable member 22. In some embodiments, the hanger bracket 26 supports an axle 23, and the axle 23 supports the rotatable member 22. In some embodiments, an axle 23 can include bushings and/or end fasteners, for example as disclosed in U.S. Pat. No. 9,528,788.

In some embodiments, a hanger bracket 26 is attached to the first limb member 40, and the first limb member 40 provides direct support to the hanger bracket 26. In some embodiments, the second limb 42 is not attached to the hanger bracket 26. In some embodiments, the second limb 42 applies a force to the first limb 40, wherein the second limb 42 provides indirect support to the hanger bracket 26.

In some embodiments, the first limb member 40 is supported by a limb cup 20 at a first location 70 and is supported by the second limb member 42 at a second location 72. In some embodiments, the first location 70 and second location 72 are location near opposite ends of the first limb member 40. In some embodiments, the second limb member 42 can have any suitable length and can provide support to the first limb member 40 anywhere along the length of the first limb member 40.

In some embodiments, a hanger bracket 26 comprises a body having a U-shape that abuts the first limb member 40 and straddles the first and second limb members 40, 42. In some embodiments, the hanger bracket 26 engages the axle 23 at multiple locations.

In some embodiments, the first limb member 40 and the second limb member 42 contact one another directly along at least a portion of their length. In some embodiments, the first limb member 40 and the second limb member 42 extend substantially parallel to one another.

In some embodiments, a spacer 43 is positioned between the first limb member 40 and the second limb member 42. In some embodiments, the second limb member 42 applies forces to the spacer 43 and the spacer 43 applies forces to the first limb member 40.

In some embodiments, the spacer 43 is attached to the first limb member 40 and is not fixedly attached to the second limb member 42. In some embodiments, the spacer 43 is attached to the second limb member 42 and not attached to the first limb member 40. In some embodiments, the spacer 43 is fixedly attached to one of the limb members 40, 42 and is configured to slide along the other of the limb members 40, 42. In some embodiments, the spacer 43 comprises a low friction material, for example a material having a lower coefficient of friction than the limb member(s) 40, 42.

In some embodiments, the spacer 43 is attached to both the first limb member 40 and the second limb member 42.

In some embodiments, a gap 41 is provided between the first limb member 40 and the second limb member 42 along at least a portion of the length of the limb assembly 30.

In some embodiments, a limb assembly 30 comprises a first limb assembly portion 34 and a second limb assembly portion 36. In some embodiments, the first limb assembly portion 34 and the second limb assembly portion 36 collectively support the rotatable member 22. In some embodiments, the first limb assembly portion 34 is positioned on a first side of the rotatable member 22 and the second limb assembly portion 36 is positioned on a second side of the rotatable member 22.

In some embodiments, the first limb assembly portion 34 comprises the limb members 40, 42 and hanger bracket 26 as described herein. In some embodiments, the second limb assembly portion 36 comprises components that are similar to the first limb assembly portion 34. For example, in some embodiments, a second limb assembly portion 36 comprises a third limb member 50 and a fourth limb member 52, wherein the third limb member 50 comprises features similar to the first limb member 40 and the fourth limb member 52 comprises features similar to the second limb member 42. In some embodiments, the second limb assembly portion 36 comprises a second hanger bracket 27, wherein the second hanger bracket 27 comprise features similar to the hanger bracket 26. In some embodiments, the hanger bracket 26 and second hanger bracket 27 both support the axle 23.

The limb members 40, 42, 50, 52 can comprise any suitable material and have any suitable size and shape. In some embodiments, a limb member 40 comprises a composite material comprising longitudinal reinforcing fibers. In some embodiments, a limb member 40 comprises a thermoset material.

The limb members 40, 42, 50, 52 can each have any suitable length, width and height dimensions. In some embodiments, limb members 40, 42, 50, 52 can have similar sizes and shapes. In some embodiments, various limb members 40, 42, 50, 52 can be different from one another.

In some embodiments, a second limb member 42 is different from a first limb member 40. In some embodiments, the length of a second limb member 42 can be less than, or greater than, the length of a first limb member 40. In some embodiments, the width of a second limb member 42 can be less than, or greater than, the width of a first limb member 40.

In some embodiments, a limb member 40, 42, 50, 52 tapers along its length. In some embodiments, various limb members 40, 42, 50, 52 can have similar tapers or different amounts of tapering along their length.

In some embodiments, the limb members 40, 42, 50, 52 extend away from the riser 12 at angles that are similar to one another. In some embodiments, various limb members 40, 42, 50, 52 can extend at different initial take-off angles. For example, a first limb member 40 can extend away from the riser at a first take-off angle and a second limb member 42 can extend away from the riser at a second take-off angle, wherein the second take-off angle can be greater than or less than the first take-off angle.

In some embodiments, the limb assembly 30 is supported by a limb cup 20. Desirably, the limb cup 20 comprises one or more cavities for receiving limb members 40, 42, 50, 52. In some embodiments, a limb cup 20 and limb members 40, 42, 50, 52 comprise complimentary engagement features, for example as disclosed in U.S. Pat. No. 8,453,635.

Desirably, a limb cup 20 provides engagement between a limb assembly 30, or a portion of a limb assembly 30, and the riser 12. In some embodiments, a limb cup 20 comprises a first surface 56 arranged to contact a tension surface 58 of a limb member 40 and a second surface 57 arranged to contact a compression surface 59 of the limb member 40. In some embodiments, a limb cup 20 defines a cavity 21 that receives a limb member 40, and the cavity 21 is at least partially defined by the first surface 56 and the second surface 57.

In some embodiments, a limb cup 20 comprises a cavity 21 for each limb member 40, 42, 50, 52. In some embodiments, multiple limb members 40, 42 can be received in the same cavity.

Figure 4:
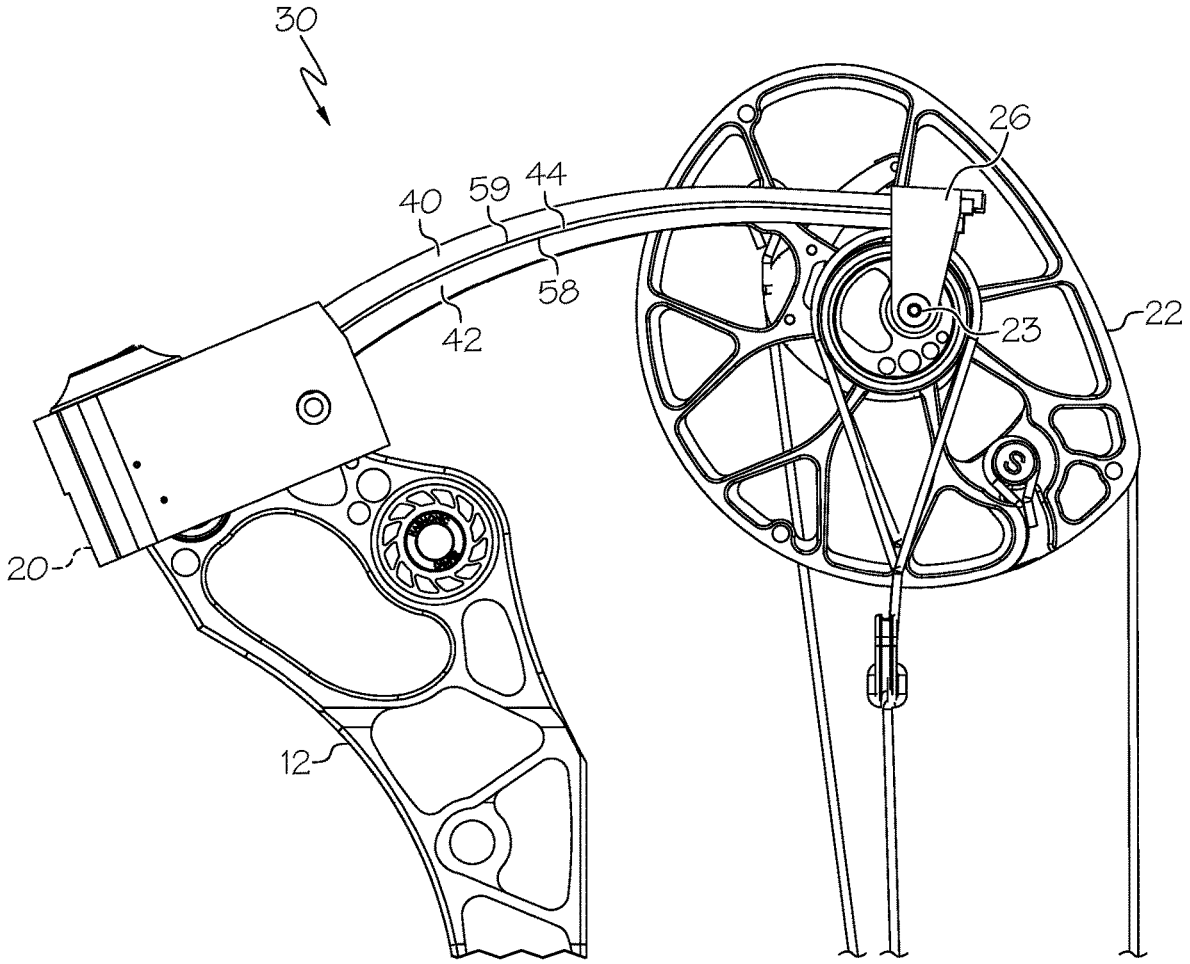
FIG. 4 shows a side view of another embodiment of a limb assembly.
Figure 5:
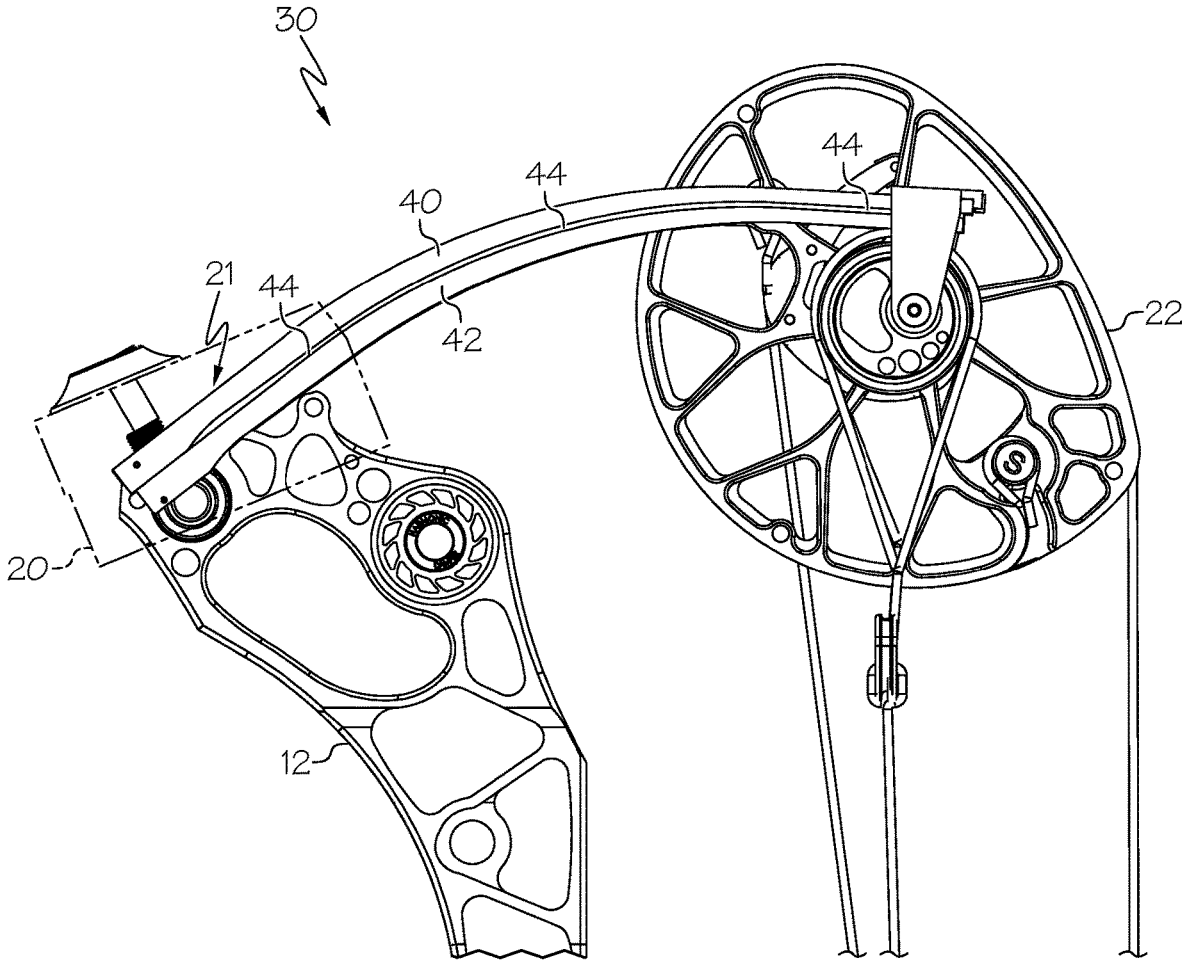
FIG. 5 shows a view similar to FIG. 4 with an interior of a limb cup visible.
Figure 6:
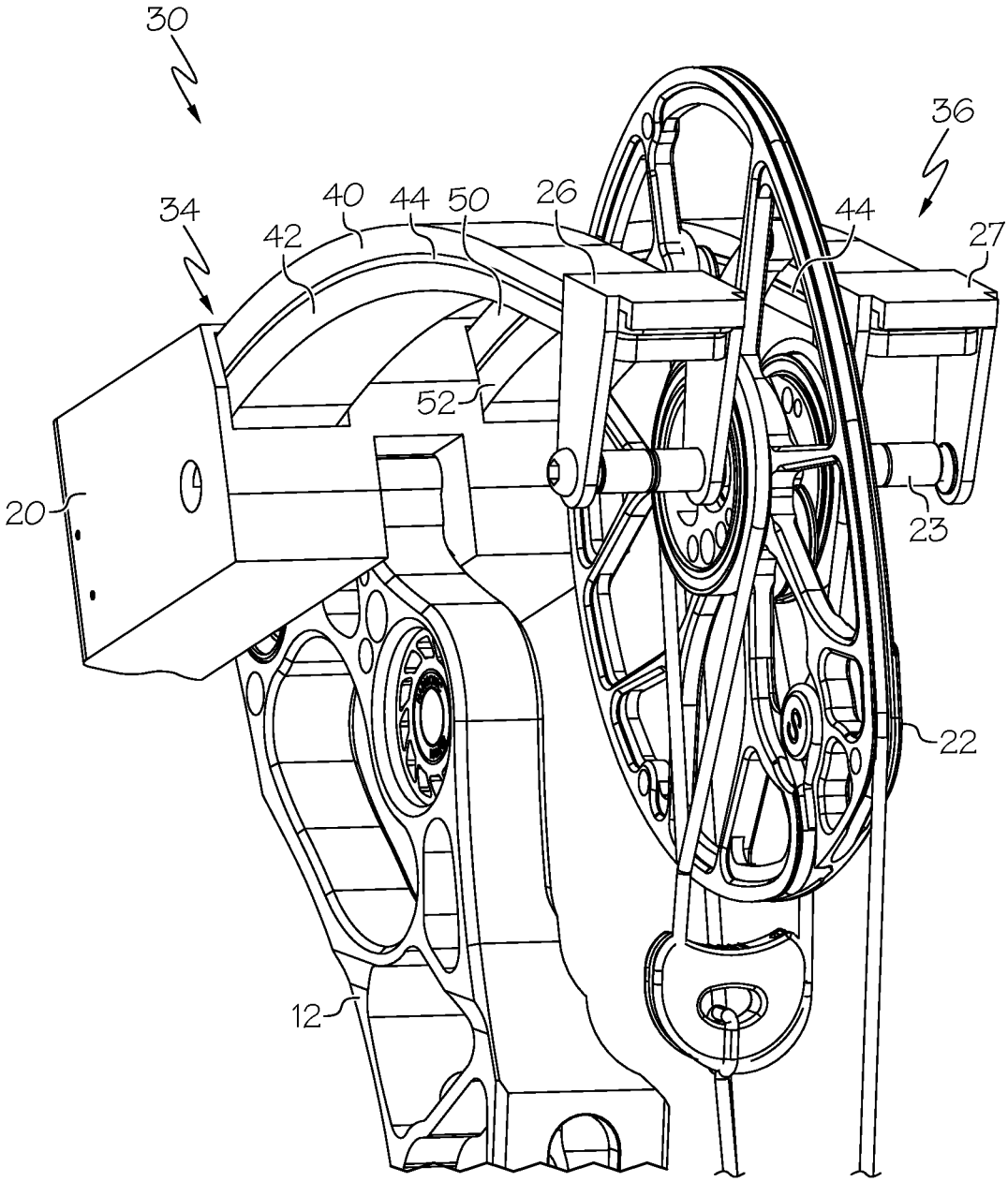
FIG. 6 shows another embodiment of a limb assembly.

FIGS. 4-6 show another embodiment of an archery bow 10 and another embodiment of a limb assembly 30.

In some embodiments, a limb assembly 30 comprises a damping material 44 oriented between limb members 40, 42, 50, 52. In some embodiments, the damping material 44 contacts the compression surface 59 of one limb member 40. In some embodiments, the damping material 44 contacts the tension surface 58 of another limb member 42.

In some embodiments, the damping material 44 is attached to the first limb member 40 and is not attached to the second limb member 42. In some embodiments, the damping material 44 is attached to the second limb member 42 and is not attached to the first limb member 40. In some embodiments, the damping material 44 is attached to both the first limb member 40 and the second limb member 42. The damping material 44 can be attached to a limb member 40, 42 in any suitable way, for example using an adhesive. In some embodiments, a damping material 44 is sandwiched between limb members 40, 42 and retained in place by frictional engagement between the damping material 44 and the limb members 40, 42.

Figure 7:
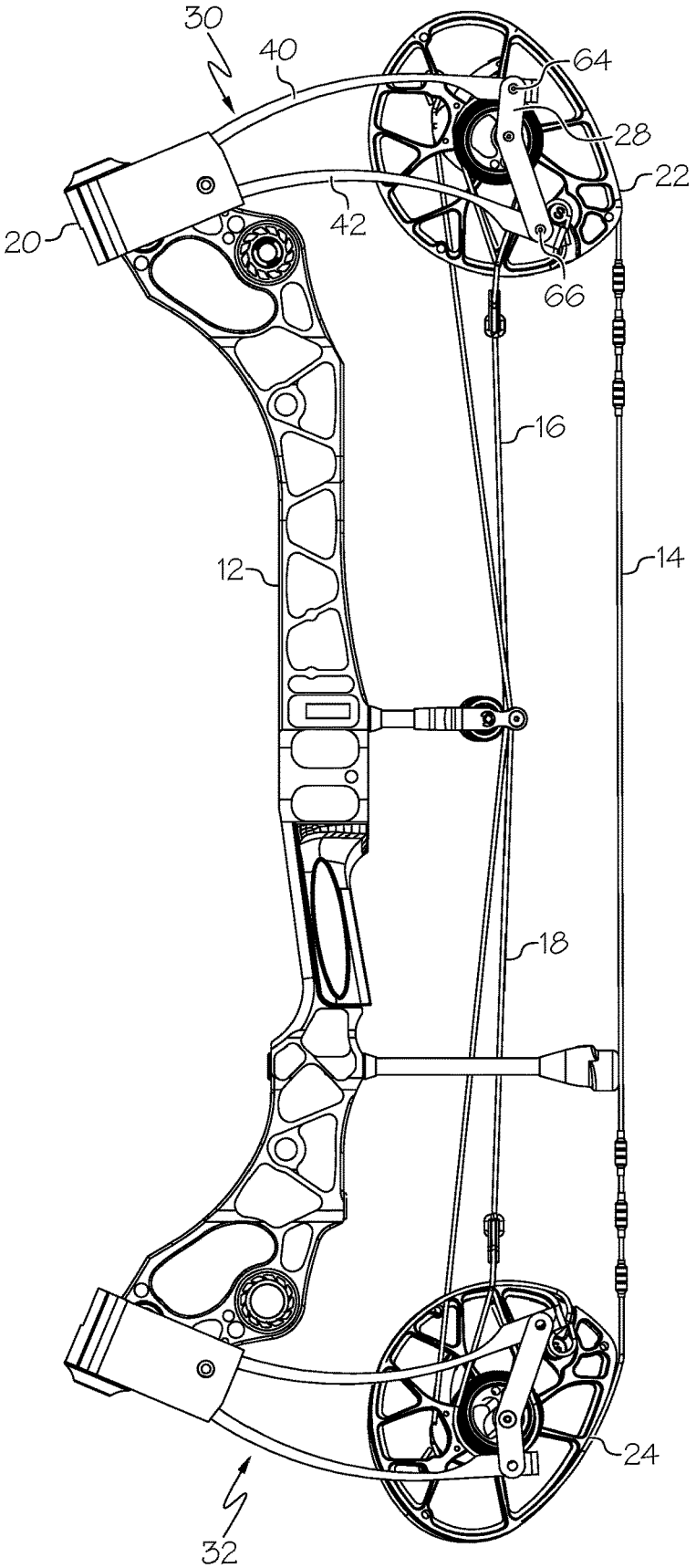
FIG. 7 shows another embodiment of an archery bow.
Figure 8:
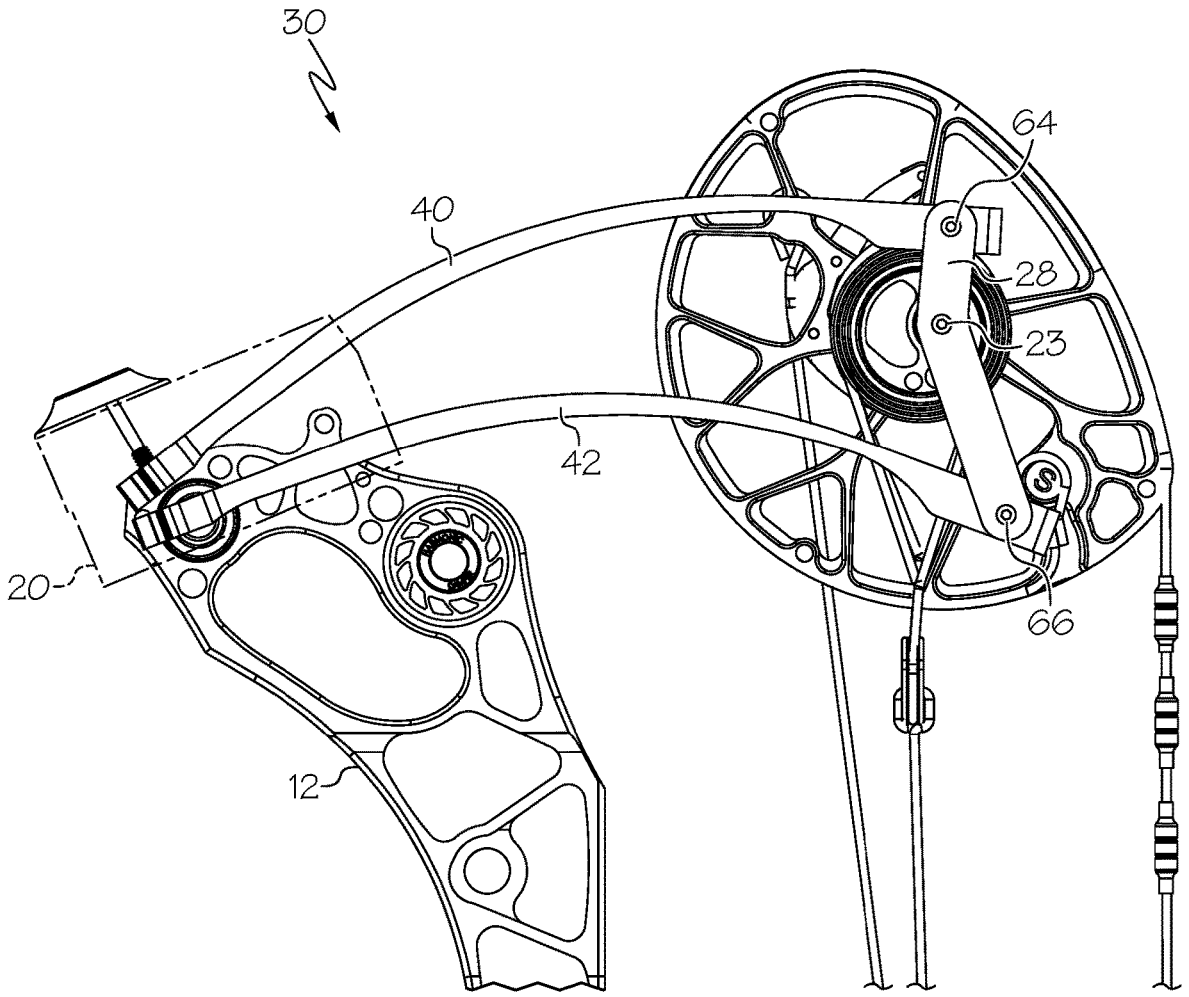
FIG. 8 shows a side view of the embodiment of FIG. 7.
Figure 9:
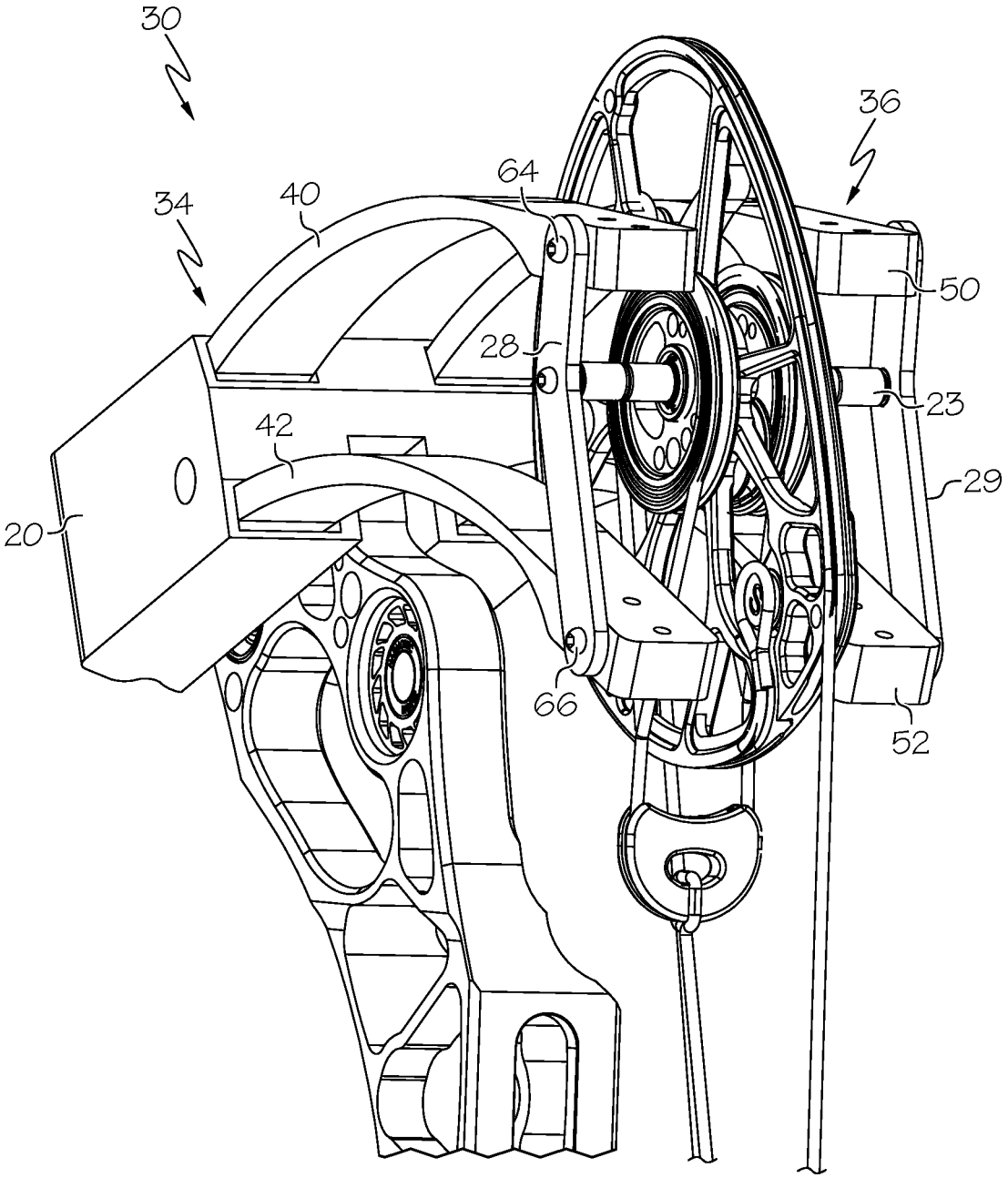
FIG. 9 shows another view of the embodiment of FIG. 7.

FIGS. 7-9 show another embodiment of a bow 10 and another embodiment of limb assemblies 30, 32.

In some embodiments, a bracket 28 is engaged with the first limb member 40 at a first connection 64 and with the second limb member 42 at a second connection 66. In some embodiments, one or both of the connections 64, 66 comprise a rotatable connection that allows the bracket 28 to rotate with respect to the limb member 40, 42.

In some embodiments, the bracket 28 supports an axle 23 at a location between the first connection 64 and the second connection 66.

As the bow 10 is drawn, the first connection 64 can follow an arcuate path and the second connection 66 can follow a different arcuate path. The axle 23 can also move as the bow 10 is drawn, and the axle 23 can follow a path that is different from the typical path of movement exhibited in a traditional archery bow.

In some embodiments, the bow 10 comprises a first limb assembly portion 34 and a second limb assembly portion 36 similar to the first limb assembly portion 34. In some embodiments, the second limb assembly portion 36 comprises a second bracket 29, and the first bracket 28 and second bracket 29 support the rotatable member 22.

Although the Figures herein illustrate compound bows, the stacked limb concept can be used with non-compound bows. For example, in some embodiments of a bow, a bowstring 14 is attached directly to the limb assembly 30, for example being attached to the first limb member 40.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A limb assembly comprising:

a limb cup;

a first limb member comprising a first portion engaged with the limb cup and a second portion extending away from the limb cup; and a second limb member comprising a first portion engaged with the limb cup and a second portion extending away from the limb cup;

the first limb member and the second limb member arranged to support a rotatable member, the first portion of the first limb member oriented nonparallel to the first portion of the second limb member.

2. The limb assembly of claim 1, the second portion of the first limb member oriented nonparallel to the second portion of the second limb member.

3. The limb assembly of claim 1, wherein a compression surface of the first limb member is adjacent to a tension surface of the second limb member.

4. The limb assembly of claim 3, comprising a gap located between the first limb member and the second limb member.

5. The limb assembly of claim 1, comprising a bracket attached to the first limb member and the second limb member.

6. The limb assembly of claim 5, the bracket arranged to support the rotatable member.

7. The limb assembly of claim 5, the bracket rotatable with respect to the first limb member.

8. The limb assembly of claim 7, the bracket rotatable with respect to the second limb member.

9. The limb assembly of claim 1, the limb cup comprising a first cavity and a second cavity, a portion of the first limb member oriented in the first cavity, a portion of the second limb member oriented in the second cavity.

10. The limb assembly of claim 1, comprising a third limb member engaged with the limb cup and a fourth limb member engaged with the limb cup.

11. The limb assembly of claim 10, the third limb member and the fourth limb member arranged to support the rotatable member.

12. The limb assembly of claim 11, the third limb member extending parallel to the first limb member.

13. The limb assembly of claim 12, the fourth limb member extending parallel to the second limb member.

14. The limb assembly of claim 11, the rotatable member oriented between the first limb member and the third limb member.

15. The limb assembly of claim 14, the rotatable member oriented between the second limb member and the fourth limb member.

16. An archery bow comprising:

a riser;

a first limb member comprising a first portion supported by the riser and a second portion extending away from the riser;

a second limb member comprising a first portion supported by the riser and a second portion extending away from the riser;

a third limb member supported by the riser and a fourth limb member supported by the riser;

the first limb member and the second limb member supporting a rotatable member, the first portion of the first limb member oriented nonparallel to the first portion of the second limb member.

17. The archery bow of claim 16, the second portion of the first limb member oriented nonparallel to the second portion of the second limb member.

18. The archery bow of claim 16, comprising a first bracket supported by the first limb member and the second limb member, the first bracket supporting the rotatable member.

19. The archery bow of claim 16, comprising a second bracket supported by the third limb member and the fourth limb member, the second bracket supporting the rotatable member.

* * * * *